US009561891B2

(12) United States Patent
Sumitomo

(10) Patent No.: US 9,561,891 B2
(45) Date of Patent: Feb. 7, 2017

(54) PACKAGING BOX WITH CORNER BUFFERS

(71) Applicant: KYOCERA Document Solutions Inc., Osaka (JP)

(72) Inventor: Seiji Sumitomo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/722,947

(22) Filed: May 27, 2015

(65) Prior Publication Data

US 2015/0344171 A1 Dec. 3, 2015

(30) Foreign Application Priority Data

May 28, 2014 (JP) ..... 2014-109729

(51) Int. Cl.
*B65D 81/05* (2006.01)

(52) U.S. Cl.
CPC ..... *B65D 81/056* (2013.01)

(58) Field of Classification Search
CPC ..... B65D 5/02; B65D 5/0227; B65D 5/42; B65D 5/4266; B65D 5/44; B65D 5/445; B65D 5/50; B65D 5/5033; B65D 81/04; B65D 81/055; B65D 81/056; B65D 81/06
USPC ..... 206/453, 586, 587
See application file for complete search history.

(56) References Cited

FOREIGN PATENT DOCUMENTS

| | | | | |
|---|---|---|---|---|
| JP | S48-110329 U | | 12/1973 | |
| JP | S49-114084 U | | 9/1974 | |
| JP | S52-47081 U | | 4/1977 | |
| JP | 53000793 A | * | 1/1978 | |
| JP | S53-146628 U | | 11/1978 | |
| JP | 30187868 A | * | 8/1991 | ..... B65D 81/06 |
| JP | 2004-3104791 U | | 10/2004 | |
| JP | 2005206225 A | * | 8/2005 | ..... B65D 5/12 |
| JP | 2007-276808 A | | 10/2007 | |

OTHER PUBLICATIONS

An Office Action; "Notice of Reasons for Rejection," issued by the Japanese Patent Office on Jul. 12, 2016, which corresponds to Japanese Patent Application No. 2014-109729 and is related to U.S. Appl. No. 14/722,947.

* cited by examiner

*Primary Examiner* — Bryon Gehman
(74) *Attorney, Agent, or Firm* — Studebaker & Brackett PC

(57) ABSTRACT

A packaging box includes a body part, flaps and a buffer. The body part has a rectangular bottom plate and side plates erected from four sides of the bottom plate, and is provided with an opening at an upper face. The flaps are connected to upper edges of the side plates via fold lines to close the opening by being folded inside. The buffer is interposed between the body part and a packaged article. The buffer has an engaging groove formed so as to grip the side plate and the flap folded up the outside of the side plate by being folded back outside along the fold line.

4 Claims, 4 Drawing Sheets

PACKAGING BOX WITH CORNER BUFFERS

INCORPORATION BY REFERENCE

This application is based on and claims the benefit of priority from Japanese Patent application No. 2014-109729 filed on May 28, 2014, the entire contents of which are incorporated herein by reference.

BACKGROUND

The present disclosure relates to a packaging box for protecting a packaged article during its conveyance, storage and others.

A type-A packaging box formed of a packaging material, such as a cardboard, is often used in conveying or storing an image forming apparatus, such as a printer, a copying machine, a facsimile or a multifunctional peripheral, or components composing the image forming apparatus. The type-A packaging box is a box formed such that an opening of a box-like body part is opened/closed by a plurality of folding flaps. This type of box is widely used because it is relatively inexpensive.

In such a packaging box, when the flaps are folded outside and the opening is opened in order to take out the packaged article, the flaps are not folded along an outer face of the body part but project in an oblique-downwardly outward direction from an upper edge of the body part. In such a case, during a work taking in/out the packaged article, a worker's leg comes in contact with a tip end of the flap to interfere the work and to make the working posture unstable, and therefore, work efficiency is deteriorated. In a case where the packaging box has a cubic shape, because a length of the flap is lengthened, the tip end of the flap frequently interferes.

Thereupon, as a dedicated member for fixing the flap, a holding assembly may be used to grip and to fix adjacent side plates and the flaps which are opened and folded up the outside of the side plates at a corner of the body part.

However, if such a dedicated holding assembly is used, it costs to manufacture the holding assembly, management of a storage space of the holding assembly is needed and a man-hour increases because a worker goes to the storage space to get the holding assembly when opening the packaging box.

SUMMARY

In accordance with an embodiment of the present disclosure, a packaging box includes a body part, flaps and a buffer. The body part has a rectangular bottom plate and side plates erected from four sides of the bottom plate, and is provided with an opening at an upper face. The flaps are connected to upper edges of the side plates via fold lines to close the opening by being folded inside. The buffer is interposed between the body part and a packaged article. The buffer has an engaging groove formed so as to grip the side plate and the flap folded up the outside of the side plate by being folded back outside along the fold line.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, a packaging box of an embodiment of the present disclosure will be described with reference to the drawings.

Figure 1A:
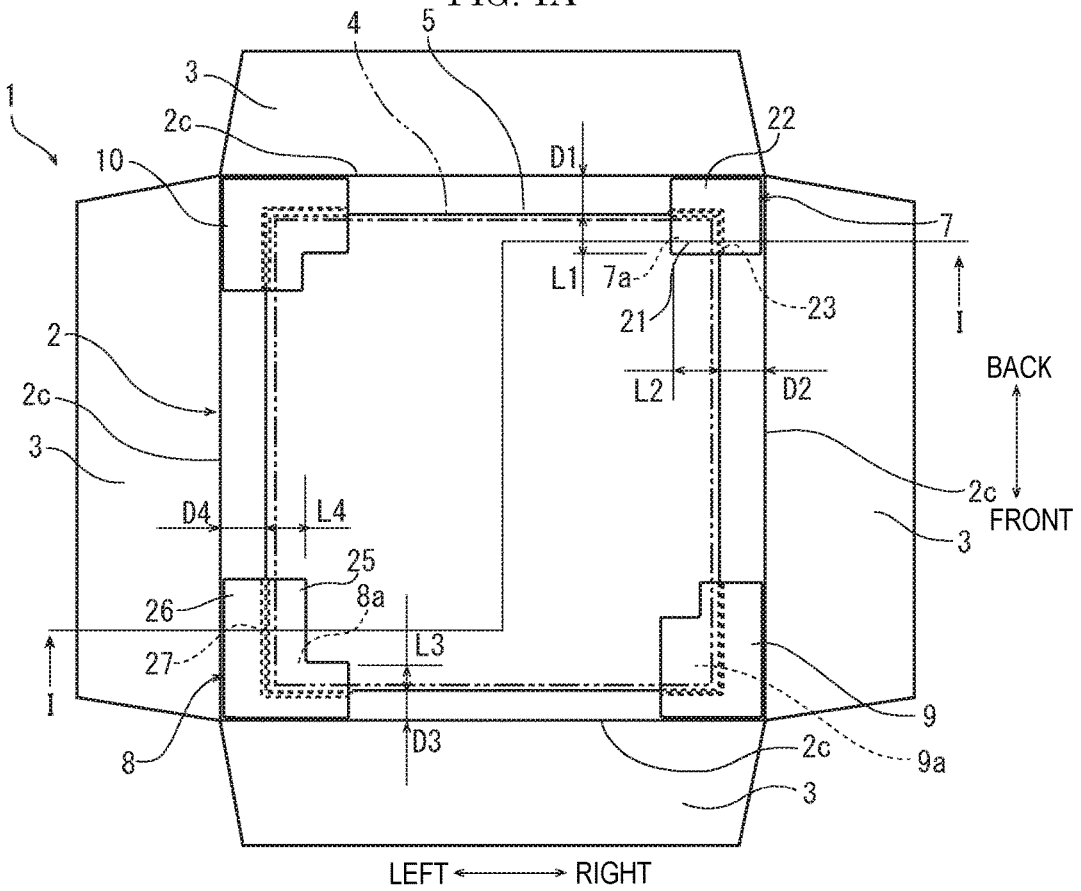
FIG. 1A is a plan view showing a packaging box in an opened state according to an embodiment of the present disclosure.
Figure 1B:
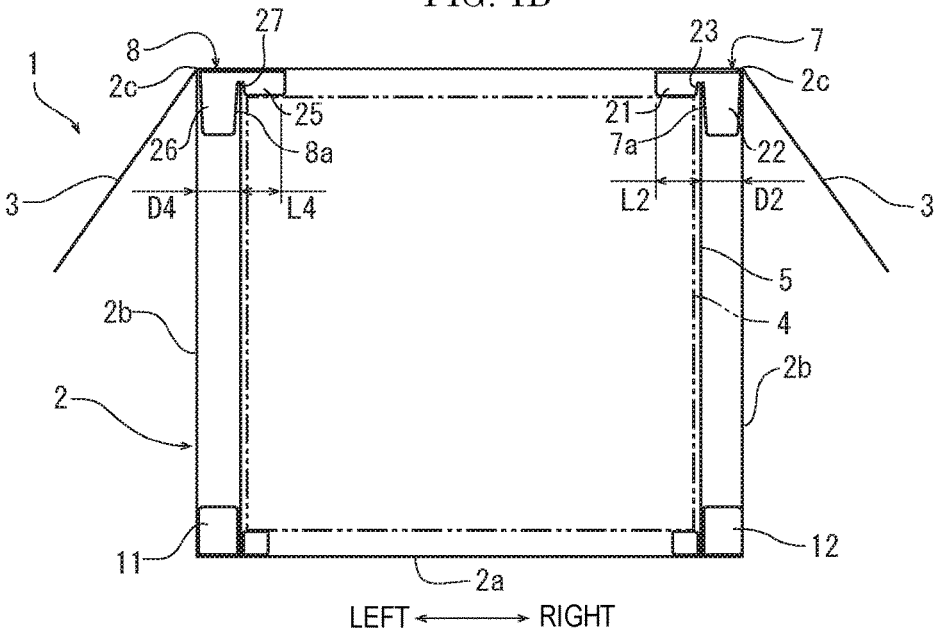
FIG. 1B is a sectional view taken along line I-I of FIG. 1A.
Figure 2A:
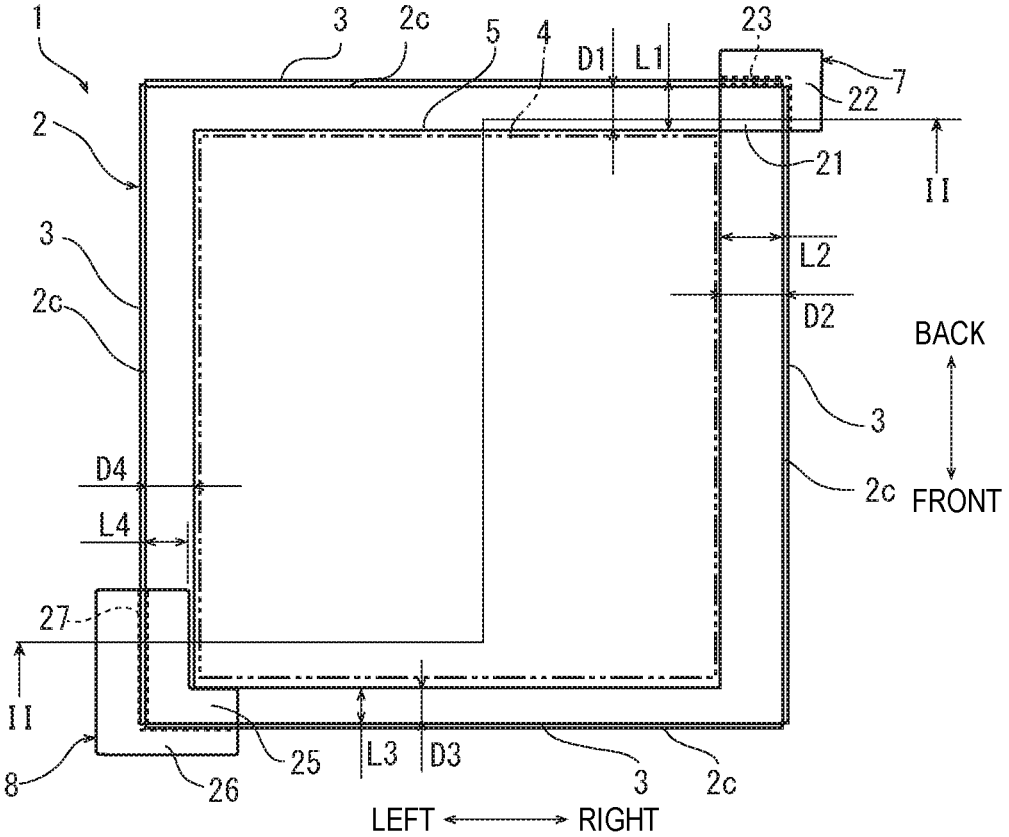
FIG. 2A is a plan view showing the packaging box in the opened state when flaps are folded up the outside of a body part and fixed by a buffer according to the embodiment of the present disclosure.
Figure 2B:
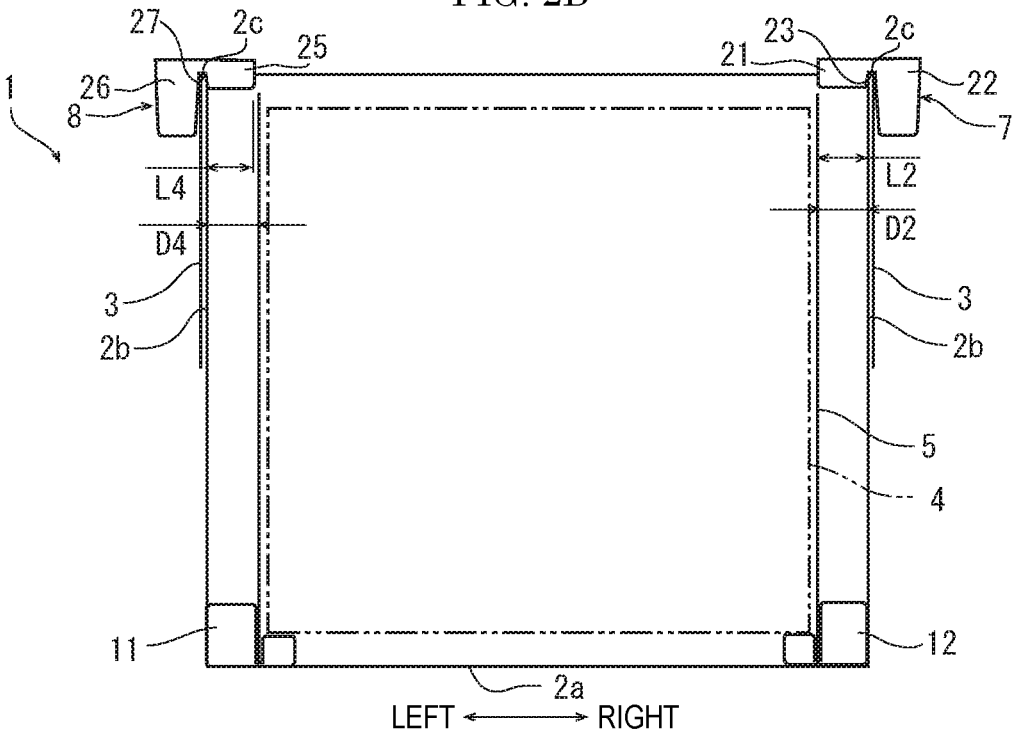
FIG. 2B is a sectional view taken along line II-II of FIG. 2A.

The packaging box of the embodiment of the present disclosure will be described with reference to FIGS. 1A, 1B, 2A and 2B. FIG. 1A is a plan view showing the packaging box in an opened state and FIG. 1B is a sectional view taken along line I-I of FIG. 1A. FIG. 2A is a plan view showing the packaging box in the opened state when flaps are folded and fixed up the outside of a body part and FIG. 2B is a sectional view taken along line II-II of FIG. 2A. In the following description, assuming that a lower side of FIG. 1A shows the front side of the packaging box and left and right directions are based on the forward and backward directions.

As shown in FIGS. 1A and 1B, the packaging box 1 includes a body part 2 provided with an opening at an upper face, flaps 3 closing the opening, a reinforcing frame 5 arranged inside the body part 2 to surround a packaged article 4 and buffers 7, 8, 9, 10, 11 and 12 arranged around the packaged article 4. The packaging box 1 is made of, for example, a high strength packaging material, such as a cardboard. The packaged article 4 is, for example, an image forming apparatus having a roughly cubic shape.

The body part 2 is formed by a roughly square bottom plate 2*a* and roughly square side plates 2*b* erected from four sides of the bottom plate 2*a* and has a cubic shape.

Each of the flaps 3 has a horizontal elongated rectangular shape and is connected to each upper side of the respective side plate 2*b* through a fold line 2*c*.

The reinforcing frame 5 is a reinforcing member applying strength in a vertical direction when the packaging boxes 1 are piled up. The reinforcing frame 5 has a rectangular cylindrical shape surrounding an outer periphery of the packaged article 4 and may be formed, for example, by folding a horizontal elongated rectangular packaging material along four fold lines extending in the vertical direction.

The buffers 7 and 8 are arranged at corners (at a right rear corner and a left front corner) on one diagonal line of an upper end of the body part 2 and the buffers 9 and 10 are arranged at corners (at a right front corner and a left rear corner) on the other diagonal line. These buffers 7-10 are interposed between the packaged article 4 and the side plates 2*b* via the reinforcing frame 5. The buffers 11 and 12 are arranged at a lower end of the body part 2 and interposed between the packaged article 4 and the bottom plate 2*a* via the reinforcing frame 5. These buffers 7-12 are made of pulp mold.

Figure 3A:
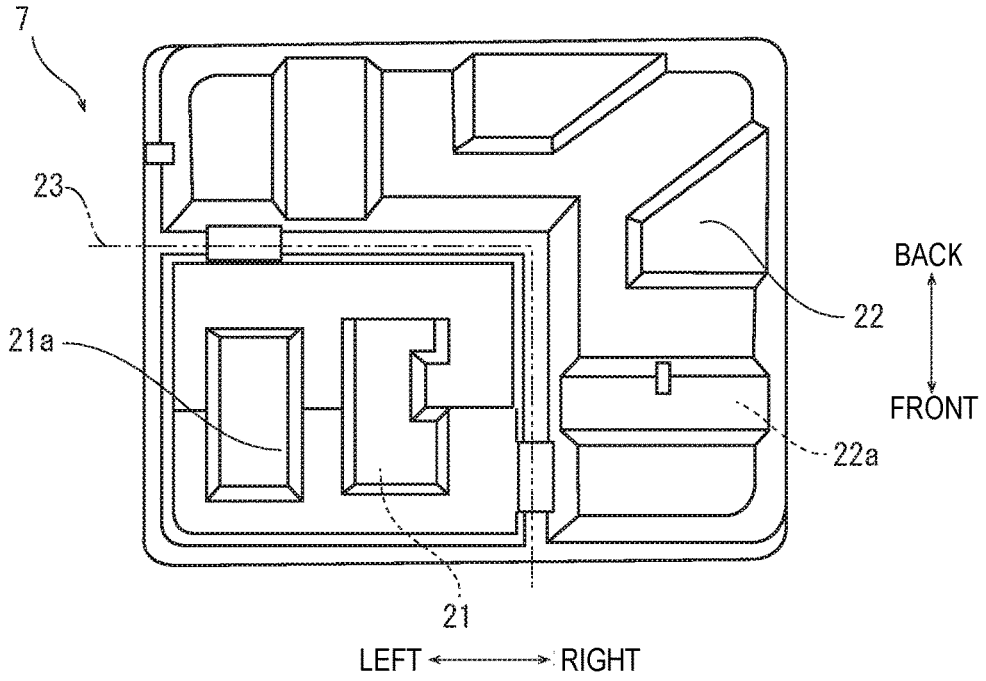
FIG. 3A is a plan view showing the buffer located at a right front corner of a packaged article in the packaging box according to the embodiment of the present disclosure.
Figure 3B:
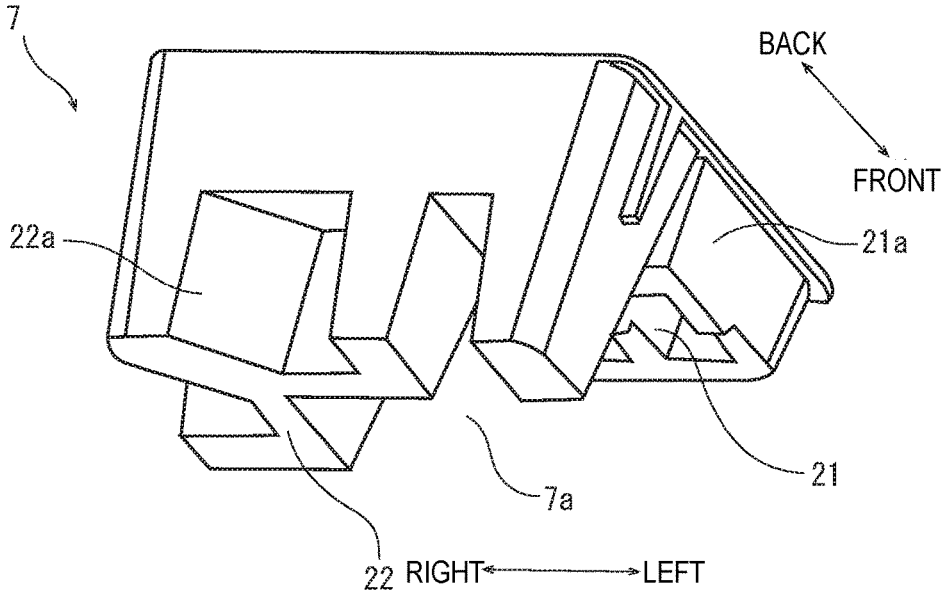
FIG. 3B is a lower perspective view showing the buffer located at the right front corner of the packaged article in the packaging box according to the embodiment of the present disclosure.

A pair of the buffers 7 and 8 arranged at the corners (at the right rear corner and the left front corner) on the one diagonal line of the body part 2 will be described with reference to FIGS. 1A, 1B, 2A, 2B, 3A and 3B. FIG. 3A is a plan view and FIG. 3B is a lower perspective view showing the buffer 7 arranged at the right rear corner.

The right rear corner buffer 7 arranged at the right rear corner is a cubic block shaped member and, at a left front corner of its lower face, a cut out portion 7*a* in a rectangular parallelepiped shape is formed so as to be engageable with a right rear corner of the packaged article 4. The right rear corner buffer 7 has an inner periphery part 21 composing a bottom face of the cut out portion 7*a*, an outer periphery part 22 composing a back side face and a right side face of the cut out portion 7*a* and a groove 23 (an engaging groove) in an L-shape reversed in the upward and downward directions and the left and right directions in a plane view formed between the inner periphery part 21 and the outer periphery part 22.

The inner periphery part 21 has a rectangular planar shape and, on its lower face, a protrusion 21*a* corresponding to a shape of the right rear corner of the packaged article 4 is formed. As shown in FIGS. 1A and 1B, the inner periphery part 21 is formed so that a length L1 in a direction of a width D1 of a gap between the side plate 2*b* and the reinforcing frame 5 facing to this side plate 2*b* in the rear side of the body part 2 is smaller than the width D1 of the gap, and a length L2 in a direction of a width D2 of a gap between the side plate 2*b* and the reinforcing frame 5 facing to this side plate 2*b* in the right side of the body part 2 is smaller than the width D2 of the gap.

The outer periphery part 22 has a planar shape in an L-shape reversed in the upward and downward directions and the left and right directions and, on its lower face, a plurality of protrusions 22*a* in a reversed trapezoid shape in aside view are formed at predetermined intervals. The protrusion 22*a* of the outer periphery part 22 has a height three times as high as the protrusion 21*a* of the inner periphery part 21.

The groove 23 is formed on the lower face of the right rear corner buffer 7 between the protrusion 21*a* of the inner periphery part 21 and the protrusions 22*a* of the outer periphery part 22 and has a width equal to a thickness of the reinforcing frame 5.

The left front corner buffer 8 arranged on the diagonal of the right rear corner buffer 7 is also configured similarly to the right rear corner buffer 7 and, as shown in FIGS. 1A, 1B, 2A and 2B, at a right rear corner of its lower face, a cut out portion 8*a* in a rectangular parallelepiped shape is formed so as to be engageable with a left front corner of the packaged article 4. The left front corner buffer 8 has an inner periphery part 25 composing a bottom face of the cut out portion 8*a*, an outer periphery part 26 composing a front side face and a left side face of the cut out portion 8*a* and a groove 27 (an engaging groove) in an L-shape in a plane view formed between the inner periphery part 25 and the outer periphery part 26.

The inner periphery part 25 has an L-shape in a plane view and, on its lower face, a protrusion corresponding to a shape of the left front corner of the packaged article 4 is formed. The inner periphery part 25 is formed so that a length L3 in a direction of a width D3 of a gap between the side plate 2*b* and the reinforcing frame 5 facing to this side plate 2*b* in the front side of the body part 2 is smaller than the width D3 of the gap, and a length L4 in a direction of a width D4 of a gap between the side plate 2*b* and the reinforcing frame 5 facing to this side plate 2*b* in the left side of the body part 2 is smaller than the width D4 of the gap. Incidentally, because configurations of the outer periphery part 26 and the groove 27 are similar to the outer periphery part 22 and the groove 23 of the right rear corner buffer 7, their descriptions are omitted.

Figure 4A:
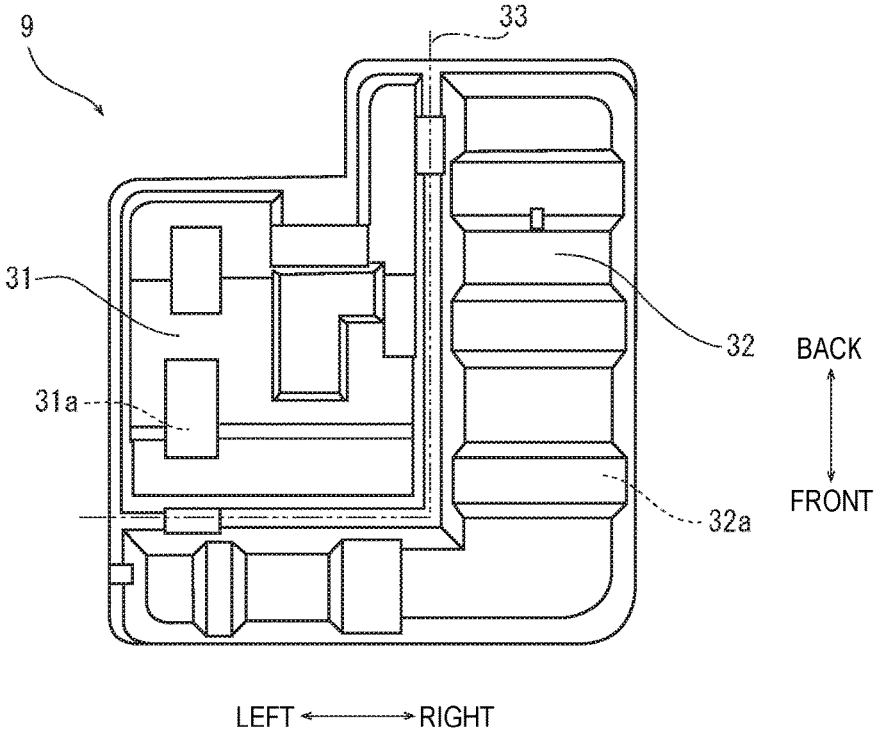
FIG. 4A is a plan view showing a buffer located at a right rear corner of the packaged article in the packaging box according to the embodiment of the present disclosure.
Figure 4B:
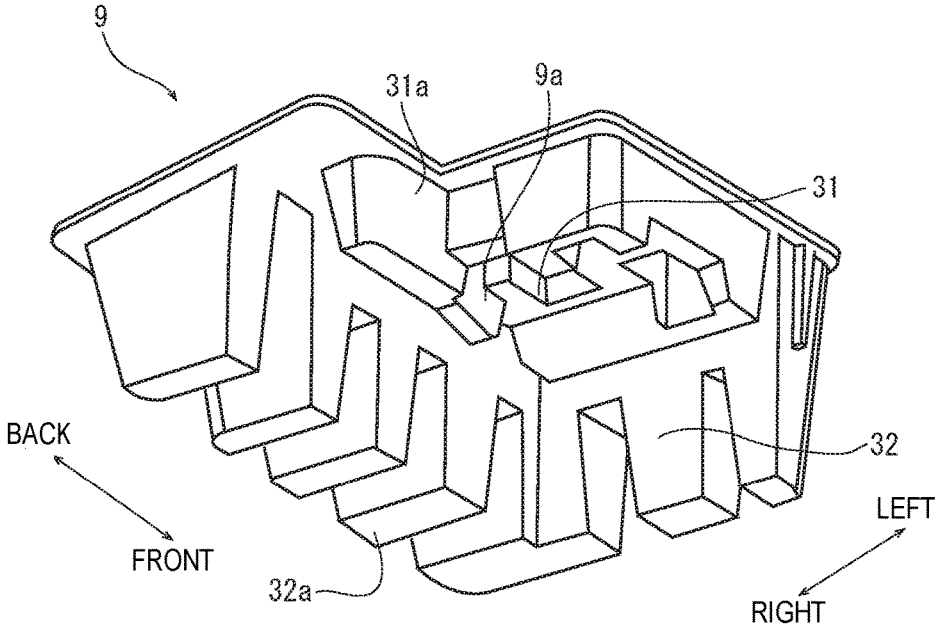
FIG. 4B is a lower perspective view showing the buffer located at the right rear corner of the packaged article in the packaging box according to the embodiment of the present disclosure.

A pair of the buffers 9 and 10 arranged at the corners (at the right front corner and the left rear corner) on the other diagonal line of the body part 2 will be described with reference to FIGS. 4A and 4B. FIG. 4A is a plan view and FIG. 4B is a lower perspective view showing the buffer 9 arranged at the right front corner.

The right front corner buffer 9 is a roughly rectangular parallelepiped block shaped member and, at a left rear corner of its lower face, a cut out portion 9*a* in a rectangular parallelepiped shape is formed so as to be engageable with a right front corner of the packaged article 4. The right front corner buffer 9 has an inner periphery part 31 composing a bottom face of the cut out portion 9*a*, an outer periphery part 32 composing a front side face and a right side face of the cut out portion 9*a* and a groove 33 in an L-shape reversed in the left and right directions formed between the inner periphery part 31 and the outer periphery part 32. The inner periphery part 31 has a roughly rectangular planer shape cut off in a rectangular shape at its left rear corner and, on its lower face, a protrusion 31*a* corresponding to a shape of the right front corner of the packaged article 4 is formed. The outer periphery part 32 has a planer shape in an L-shape reversed in the left and right directions and, on its lower face, a plurality of protrusions 32*a* in a reversed trapezoid shape in lateral view are formed at predetermined intervals. The protrusions 32*a* of the outer periphery part 32 have a height three times as high as the protrusion 31*a* of the inner periphery part 31.

The groove 33 is formed on the lower face of the right front corner buffer 9 between the protrusion 31*a* of the inner periphery part 31 and the protrusion 32*a* of the outer periphery part 32 and has a width equal to a thickness of the reinforcing frame 5. Incidentally, because the left rear corner buffer 10 arranged on the diagonal of the right front corner buffer 9 has the similar configuration to the right front corner buffer 9, its description are omitted.

The right rear corner buffer 7 and the right front corner buffer 9, as well as the left front corner buffer 8 and the left rear corner buffer 10 are respectively united in a body by a thin connecting part with punch holes, and then, when using, separated by cutting along the punch holes.

In the packaging box 1 having the above-described configuration, when a roughly cubic packaged article 4, such as the image forming apparatus, is packaged, the packaged article 4 is covered by a resin protection cover or the like and then stored in the body part 2 via the bottom buffers 11 and 12. After that, the periphery of the packaged article 4 is surrounded by the reinforcing frame 5.

Subsequently, at the upper ends of four corners of the body part 2, the corresponding buffers 7-10 are respectively interposed. That is, the cut out portion of each of the buffers 7-10 is engaged with each of four corners of the packaged article 4, the protrusion formed on the lower face of the outer periphery part is inserted between the adjacent side plates 2*b* and the reinforcing frame 5 facing to these side plates 2*b* at each corner of the body part 2 and then, the inner periphery part projects inwardly from the reinforcing frame 5 so that the lower face of the inner periphery part comes into contact with the corner of the upper face of the packaged article 4. Moreover, into the groove between the inner periphery part and the outer periphery part, each corner of the reinforcing frame 5 is fitted.

Thereby, between the packaged article 4 surrounded by the reinforcing frame 5 and each side plate 2*b* of the body part 2, a predetermined gap is provided. Furthermore, above the packaged article 4, a space of a height of the inner periphery parts of the buffers 7-10 is provided. Finally, one facing flaps 3 are folded inside on upper faces of the folded flaps, other facing flaps 3 are folded up and the opening of the body part 2 is closed. Between the upper face of the packaged article 4 and the flaps 3, a predetermined gap is provided.

Opening process of the packaging box 1 will be described with reference to FIGS. 2A and 2B. When opening the packaging box 1, firstly, each flap 3 is folded up an outer face of the side plate 2*b* connected to each flap 3. Subsequently, the right rear corner buffer 7 and the left front corner buffer 8 arranged at the corners on the one diagonal line are removed. Then, the adjacent two side plates 2*b* and the flaps 3 folded up these side plates 2*b* at the right rear corner of the body part 2 are griped with the groove 23 of the right rear corner buffer 7 along the fold lines 2*c*. Thereby, the flaps 3 connected to the rear side and the right side of the body part 2 are fixed along outer faces of the respective side plates 2*b*. At this time, although the inner periphery part 21 of the right rear corner buffer 7 projects between the side plates 2*b* and the reinforcing frame 5, since the inner periphery part 21 has the length L1 in the forward and backward directions and the length L2 in the left and right directions which are respectively smaller than the widths D1 in the forward and backward directions and the width D2 in the left and right directions of the gap between the side plates 2*b* and the reinforcing frame 5, the inner periphery part 21 does not interfere with the packaged article 4 in a plane view. Similarly, the adjacent side plates 2*b* and the flaps 3 folded up these side plates 2*b* at the left front corner on the diagonal of the right rear corner are griped with the groove 27 of the left front corner buffer 8 along the fold lines 2*c*. In the left front corner buffer 8, since the inner periphery part 25 has the length L3 in the forward and backward directions and the length L4 in the left and right directions which are respectively smaller than the widths D3 in the forward and backward directions and the width D4 in the left and right directions of the gap between the side plates 2*b* and the reinforcing frame 5, the inner periphery part 25 does not interfere with the packaged article 4 in a plane view. Thereby, by the right rear corner buffer 7 and the left front corner buffer 8, four flaps 3 are fixed in postures folded up the outside of the body part 2.

After that, the residual buffers 9 and 10 are removed, the protection cover is opened and then the packaged article 4 is taken out. Incidentally, although FIGS. 2A and 2B show the flaps 3 folded up along the lateral plates 2*b*, the flaps 3 may be folded in a slightly obliquely outward direction to the extent that its tip end does not interfere with a worker's leg.

As described above, in the packaging box 1 according to the embodiment, it is possible to fix the flaps 3 in the posture folded up the outside of the side plates 2*b* by using the right rear corner buffer 7 and the left front corner buffer 8 which are required for packaging of the packaged article 4. Further, since the height of positions where the right rear corner buffer 7 and the left front corner buffer 8 are arranged are equal to the height of positions where the flaps 3 are fixed when opening the packaging box 1 (the height of the fold lines 2*c*), it is possible to carry out the work fixing the opened flaps 3 following the work removing the buffers 7-10 when opening the packaging box 1. Therefore, since the flaps 3 can be fixed without using a dedicated member, it is unnecessary to cost to manufacture the dedicated member for fixing and to manage a storage space of a holding assembly. Furthermore, it is possible to carry out stably and efficiently the work taking out the packaged article 4.

Further, as shown in FIGS. 2A and 2B, when the flaps 3 and the side plates 2*b* are fixed by the right rear corner buffer 7 and the left front corner buffer 8 arranged on the one diagonal line, the inner periphery parts 21 and 25 of the right rear corner buffer 7 and the left front corner buffer 8 project in the gaps between the reinforcing frame 5 and the side plates 2*b*. However, since the inner periphery parts 21 and 25 do not reach above the packaged article 4, when taking out the packaged article 4, the inner periphery part 21 of the right rear corner buffer 7 and the inner periphery part 25 the left front corner buffer 8 do not interfere with the packaged article 4. Therefore, it is possible to smoothly take out the packaged article 4. Incidentally, since the right front corner buffer 9 and the left rear corner buffer 10 arranged on the other diagonal line are not used for fixing the flaps 3, the respective inner periphery parts may be formed so as to come into contact with the packaged article 4 with sufficient contact area. That is, the respective inner periphery parts of the right front corner buffer 9 and the left rear corner buffer 10 may be formed so as to have lengths in the forward and backward directions and in the left and right directions larger than the gaps between the side plates 2*b* and the reinforcing frame 5 in the forward and backward directions and in the left and right directions.

Moreover, because the buffers are scrapped after taking out the packaged article 4, there is no problem even if the buffers is broken along the groove somewhat when the flaps 3 folded up the outside are fixed. In each of all the buffers 7-10, sizes of the inner periphery part are not restricted and perforations or thin portion may be formed in the inner periphery part such that a part interfering with the packaged article 4 when fixing the flaps 3 is separated at the inside of the groove.

Although, in the embodiment, the engaging groove of the buffer is formed in the L-shape in order to fix the flaps 3 connected to the adjacent side plates 2*b* at the corner of the body part 2, the engaging groove may be formed in a liner shape so as to grip the flap 3 and the side plate 2*b* at a liner side edge except for the corner of the body part 2.

While the preferable embodiment and its modified example of the packaging box including this of the present invention have been described above and various technically preferable configurations have been illustrated, a technical range of the invention is not to be restricted by the description and illustration of the embodiment. Further, the components in the embodiment of the invention may be suitably replaced with other components, or variously combined with the other components. The claims are not restricted by the description of the embodiment of the invention as mentioned above.

What is claimed is:

1. A packaging box comprising:

a body part having a rectangular bottom plate and side plates erected from four sides of the bottom plate, and provided with an opening at an upper face;

flaps connected to upper edges of the side plates via fold lines to close the opening by being folded the opening side;

a buffer interposed between the body part and a packaged article; and a square pillar reinforcing frame being located inside the body part and surrounding the packaged article, wherein the buffer has an engaging groove formed so as to grip the side plates and the flaps folded up outsides of the side plates by being folded back an opposite side of the opening side along the fold lines, wherein the engaging groove has a shape engageable with a corner of the reinforcing frame, when packing, the buffer is interposed between the reinforcing frame and the side plates at a corner of the body part by engaging the engaging groove with the corner of the reinforcing frame, and when opening, the buffer grips and fixes two adjacent side plates and the flaps folded up the outsides of the two side plates, by being folded back and up the outsides in the engaging groove along the fold lines, wherein the buffer has an inner periphery part set above the packaged article when being packed and an outer periphery part interposed into a gap between the reinforcing frame and the lateral plate when being packed, the engaging groove is formed between the inner periphery part and the outer periphery part, a pair of the buffers arranged at corners on at least one diagonal line of the body part is formed so that a length of the inner periphery part projected inwardly from the reinforcing frame in the same direction as a width direction of the gap when being packed is smaller than a width of the gap.

2. The packaging box according to claim 1, wherein the buffers except for the pair of the buffers arranged on the corners on the diagonal line of the body part are formed so that a length of the inner periphery part projected inwardly from the reinforcing frame to the inside in the same direction as the width direction of the gap when being packed is larger than the width of the gap.

3. The packaging box according to claim 1, wherein the inner periphery part and the outer periphery part have a first protrusion and a second protrusion protruded downwardly, respectively, the second protrusion is formed to have a height higher than the first protrusion.

4. The packaging box according to claim 3, wherein the engaging groove is formed between the second protrusion and the first protrusion, a width of the engaging groove is gradually wider toward a direction to the first protrusion and second protrusion protruding.

* * * * *